US012534331B2

(12) United States Patent
Yamanaka et al.

(10) Patent No.: US 12,534,331 B2
(45) Date of Patent: Jan. 27, 2026

(54) JOINTED STRAND AND METHOD OF PRODUCING THE SAME

(71) Applicant: Toray Industries, Inc., Tokyo (JP)

(72) Inventors: Yusuke Yamanaka, Nagoya (JP); Takafumi Hashimoto, Nagoya (JP); Yasukazu Ono, Nagoya (JP); Tadashi Watanabe, Nagoya (JP)

(73) Assignee: Toray Industries, Inc., Tokyo (JP)

( * ) Notice: Subject to any disclaimer, the term of this patent is extended or adjusted under 35 U.S.C. 154(b) by 405 days.

(21) Appl. No.: 17/909,349

(22) PCT Filed: Mar. 15, 2021

(86) PCT No.: PCT/JP2021/010318
§ 371 (c)(1),
(2) Date: Sep. 2, 2022

(87) PCT Pub. No.: WO2021/200065
PCT Pub. Date: Oct. 7, 2021

(65) Prior Publication Data

US 2023/0091427 A1 Mar. 23, 2023

(30) Foreign Application Priority Data

Mar. 31, 2020 (JP) ..... 2020-062655

(51) Int. Cl.
*B65H 69/06* (2006.01)
*D02J 1/18* (2006.01)

(52) U.S. Cl.
CPC ..... *B65H 69/06* (2013.01); *D02J 1/18* (2013.01)

(58) Field of Classification Search
CPC ... D01F 9/12; D01F 9/133; D01F 9/32; B65H 69/06; B65H 2701/312; B65H 2701/314;
(Continued)

(56) References Cited

U.S. PATENT DOCUMENTS

2002/0157765 A1 10/2002 Takeuchi et al.
2011/0217228 A1* 9/2011 Mishima ..... D01F 9/22 428/401
2021/0032067 A1* 2/2021 Kuroda ..... B65H 51/005

FOREIGN PATENT DOCUMENTS

JP 6-10260 A 1/1994
JP 2001-151418 A 6/2001
(Continued)

OTHER PUBLICATIONS

Machine Translation of WO2018143067 (Year: 2018).*
(Continued)

*Primary Examiner* — Jennifer A Steele
(74) *Attorney, Agent, or Firm* — DLA Piper LLP (US)

(57) ABSTRACT

A jointed strand includes a superposed portion in which a first strand end in which fibers are oriented in one direction and a second strand end in which fibers are oriented in one direction are superposed; and a joint portion in which fibers of the first strand and the second strand are interlaced at the superposed portion, wherein the joint portion has a slit extending in a fiber orientation direction and a joint spot adjacent to the slit at one location or a plurality of locations aligned in a direction orthogonal to the fiber orientation direction, and monofilaments of the first strand and the second strand are interlaced at the joint spot.

7 Claims, 6 Drawing Sheets

(58) Field of Classification Search
CPC .... B65H 2701/38; D01D 5/423; D01D 11/02; D02J 1/18; B29B 15/122
See application file for complete search history.

(56) References Cited

FOREIGN PATENT DOCUMENTS

| | | | | |
|---|---|---|---|---|
| JP | 2003-292247 | A | 10/2003 | |
| JP | 2016-222431 | A | 12/2016 | |
| WO | WO-2018143067 | A1 * | 8/2018 | ..... B29C 70/06 |
| WO | WO-2019151076 | A1 * | 8/2019 | ..... B29B 15/122 |

OTHER PUBLICATIONS

Machine Translation WO2019151076 (Year: 2019).*
International Search Report dated Apr. 20, 2021, of corresponding International Application No. PCT/JP2021/010318 along with an English translation.

* cited by examiner

JOINTED STRAND AND METHOD OF PRODUCING THE SAME

TECHNICAL FIELD

This disclosure relates to a jointed strand obtained by jointing a strand formed by bundling a plurality of monofilaments, and a method of producing the jointed strand.

BACKGROUND

As one of use forms of a carbon fiber strand or a glass fiber strand (hereinafter, a strand) configured by bundling a plurality of monofilaments of carbon fiber or glass fiber, there is a chopped strand obtained by cutting a strand short. As the use form of the chopped strands, a producing and molding process has been known in which a chopped strand mat is formed by randomly spraying the chopped strand mat, and the chopped strand mat is impregnated with a thermosetting resin or a thermoplastic resin to form an intermediate material such as a sheet molding compound (SMC) or a stampable sheet, and the intermediate material is heated and pressurized to form a molded article.

In the production of SMC and a stampable sheet, it is required to continuously operate a producing apparatus to improve productivity. In general, a strand as a raw material is drawn out from a state of being wound around a bobbin and used. Therefore, for continuous operation, it is necessary to joint strand ends wound around different bobbins and continuously supply the strand.

As a general method of jointing ends of strands wound around different bobbins, a method of making a knot and connecting yarns, a method of twisting for jointing strands, and a method of interlacing for jointing monofilaments by an air splicer or the like are known.

Among them, when a knot is made so as strands are jointed, the strength of the knot varies depending on the skill of the operator, and there is a possibility that the strand is broken or the knot is not cut in a cutting step, and there is a possibility that chopped strands having a long fiber length are contaminated in a product. In addition, even when the knot passes through the cutting step, the knot may remain in the SMC or the stampable sheet, and may become a defect during heating and pressure molding.

In addition, even when the strands are jointed by twisting, a joint portion is strengthened by twisting. Therefore, there is a possibility that the chopped strands are not cut in the cutting step, and there is a possibility that the chopped strands after the cutting step are sprayed as one chopped strand lump in a twisted state, and areal weight unevenness occurs.

Furthermore, also in connecting strands with an air splicer, the number of monofilaments present at the strand joint portion is increased by superposing the yarns and interlacing the monofilaments. Due to this influence, there is a possibility that the cutability is deteriorated, and the chopped strands are sprayed as a large chopped strand lump. Even when it passes through the cutting step, the chopped strands having a large number of monofilaments are contaminated in the SMC and the stampable sheet, and the chopped strands become defects during heating and pressure molding.

Japanese Patent Laid-open Publication No. 2001-151418 discloses a method of jointing a plurality of flat strands while keeping the flat strands' shape. Japanese Patent Laid-open Publication No. 2016-222431 discloses that by performing air splicing at a plurality of places in a fiber direction, the strand jointing strength is secured even when each splice strength is weak. Further, in Japanese Patent Laid-open Publication No. 6-10260, by dividing the strand into a plurality of strands and then twisting the strands, chopped strands having a large number of monofilaments are less likely to be formed on the chopped strands after cutting, and areal weight unevenness is improved.

In Japanese Patent Laid-open Publication No. 2001-151418, the joint portion is rigid to hold and handle the flat strand shape. Therefore, when the strand is cut to obtain a chopped strand, there is a problem in cutability, and even if the joint portion can be cut, the number of monofilaments constituting the chopped strand is increased more than the number of chopped strands in other portions. In addition, there is a possibility that the characteristics of the strand subjected to a partial separation treatment for the purpose of reducing a bundle width of the chopped strands are not sufficiently exhibited.

In Japanese Patent Laid-open Publication No. 2016-222431, it is possible to reduce the splice strength of each strand in a state where the strand jointing strength of the entire joint portion is secured, to reduce interlace joint of monofilaments, and to improve the cutability. However, when such a joint portion is a chopped strand, the number of monofilaments constituting the chopped strand is increased. In addition, there is a possibility that the characteristics of the flat strand subjected to a fiber widening treatment in advance for reducing the bundle thickness of the chopped strands and the characteristics of the strand subjected to a partial separation treatment for the purpose of reducing a bundle width of the chopped strands are not sufficiently exhibited.

In Japanese Patent Laid-open Publication No. 6-10260, by twisting the strands, the joint portion becomes rigid and the cutability is deteriorated; in addition, by winding and tightening a twisted portion, the thickness is increased and the characteristics of the flat strand and the like are easily lost. In addition, since the entire superposed portion of the strand end is twisted and jointed, the area affected by the twisting is large, and when a chopped strand is formed, many chopped strands are sometimes affected by the twisting.

It could therefore be helpful to provide a jointed strand that exhibits excellent cutability in forming a chopped strand, exhibits excellent dispersity after cutting, and can control a bundle width of the chopped strand, by controlling a joint state of the strand, and a method of producing the jointed strand.

SUMMARY

We thus provide:

[1] A jointed strand including a superposed portion in which a first strand end in which fibers are oriented in one direction and a second strand end in which fibers are oriented in one direction are superposed; and a joint portion in which fibers of the first strand and the second strand are interlaced at the superposed portion, wherein the joint portion has a slit extending in a fiber orientation direction and a joint spot adjacent to the slit at one location or a plurality of locations aligned in a direction orthogonal to the fiber orientation direction, and monofilaments of the first strand and the second strand are interlaced at the joint spot.

[2] A method of producing a jointed strand including: providing a superposed portion by superposing a first strand end in which fibers are oriented in one direction and a second strand end in which fibers are oriented in one direction; providing a slit extending in a fiber orientation direction at one point or at a plurality of points arranged in a direction orthogonal to the fiber orientation direction by piercing a separation means in the superposed portion, and forming a joint spot adjacent to the slit; and jointing the first strand and the second strand at the joint spot by interlacing monofilaments to form a joint portion including the slit and the joint spot.

[3] A method of producing a jointed strand including: providing a superposed portion in which a first strand end in which fibers are oriented in one direction and a second strand end in which fibers are oriented in one direction are superposed; forming a joint portion by interlacing monofilaments of the first strand and the second strand in the superposed portion; and providing a slit extending in a fiber orientation direction and forming a joint spot adjacent to the slit by piercing a separation means in the joint portion, at one location or a plurality of locations arranged in a direction orthogonal to the fiber orientation direction.

A jointed strand exhibiting good cutability is thus obtained. When the joint portion of the obtained jointed strand is cut to obtain a chopped strand, unevenness in the number of monofilaments constituting the chopped strand and unevenness in the bundle width of the chopped strand can be reduced. Therefore, in a chopped strand mat or the like produced using the chopped strand, areal weight unevenness can be suppressed, and mechanical properties can be improved.

BRIEF DESCRIPTION OF THE DRAWINGS

In FIG. 4, (i) is a front view and (ii) is a side view.

DESCRIPTION OF REFERENCE SIGNS

Figure 1:
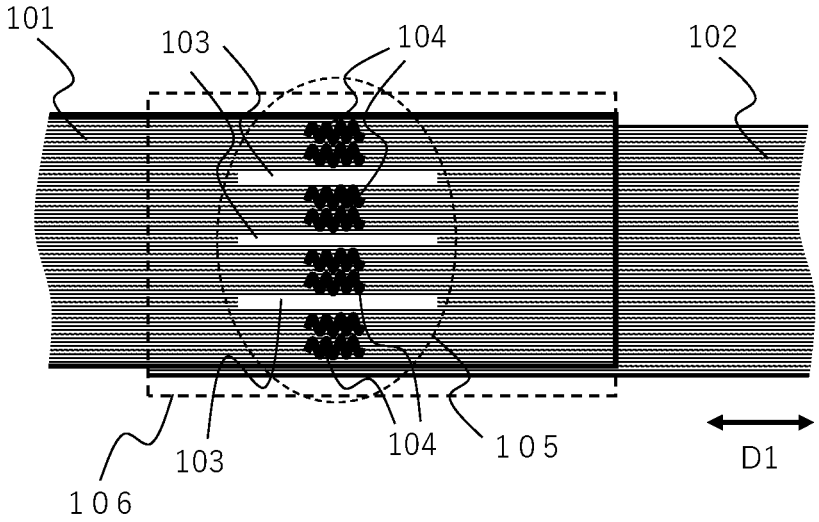
FIG. 1 is a schematic view of a jointed strand according to an example.

101: First strand
102: Second strand
103: Slit
104: Joint spot
105: Joint portion
106: Superposed portion
201: First strand
202: Second strand
203: Slit
204: Joint spot
205: Joint portion
206: Superposed portion
401: Separation means
500: Air blower
501: Air ejecting portion
502: Strand
502*a*: First strand
502*b*: Second strand
503: Superposed portion
504: Strand dividing blade
505: Strand joint portion
506: Slit
507: Joint spot
601: Strand
602: Iron plate for separation treatment
603: Contact portion
604: Protruding portion
605: Interlace joint portion
D1: Fiber orientation direction
D2: Piercing direction
D3: Strand traveling direction

DETAILED DESCRIPTION

We provide a jointed strand including a superposed portion in which a first strand end in which fibers are oriented in one direction and a second strand end in which fibers are oriented in one direction are superposed; and a joint portion in which fibers of the first strand and the second strand are interlaced at the superposed portion. The joint portion has a slit extending in a fiber orientation direction and a joint spot adjacent to the slit at one location or a plurality of locations aligned in a direction orthogonal to the fiber orientation direction, and fibers of the first strand and the second strand are interlaced by interlacing monofilaments at the joint spot. The "joint spot" and the "joint portion" are terms used in a distinguished manner; a portion obtained by combining the "joint spot" in which the monofilaments are interlaced and one or a plurality of slits adjacent thereto is referred to as the "joint portion".

The strand is formed by converging a large number of monofilaments arranged in one direction, and examples thereof include strands using organic fibers such as aramid fibers, polyethylene fibers, and polyparaphenylene benzoxazole (PBO) fibers; inorganic fibers such as glass fibers, carbon fibers, silicon carbide fibers, alumina fibers, tyrano fibers, basalt fibers, and ceramic fibers; metal fibers such as stainless steel fibers and steel fibers; boron fibers; natural fibers; and modified natural fibers, as monofilaments. These can be used as a reinforcing material of a fiber-reinforced composite material that is impregnated with a fiber and a resin to form a shape. Among them, carbon fibers (particularly, PAN-based carbon fibers) are lightweight among these reinforcing fibers, have particularly excellent properties in specific strength and specific elastic modulus, and are also excellent in heat resistance and chemical resistance, and thus are suitable for forming a fiber-reinforced composite material.

Jointing refers to a state in which the monofilaments constituting the first strand and the second strand are interlaced (interlace), and the fibers are interlaced to such an extent that the monofilaments are not easily dissociated by frictional force. As a method of joining, for example, there is a method of interlacing for jointing monofilaments by blowing air or repeatedly piercing a piercing means. As compared to forming a knot for jointing by interlacing for jointing, a cutting failure is less likely to occur in a chopped strand.

A top view of a jointed strand according to an example is illustrated in FIG. 1. In a superposed portion 106 of the jointed strand, there is a joint portion 105 including a spot where fibers are interlaced. In one joint portion 105, slits 103 and joint spots 104 are alternately arranged in a direction orthogonal to the fiber orientation direction. In each joint spot 104, the monofilament constituting the first strand 101 and the monofilament constituting the second strand 102 are interlaced with each other. At this time, if the first strand and the second strand are jointed by twisting, the monofilament is not oriented in substantially one direction so that a slit cannot be formed. Even when the slit can be formed, there is a possibility that a large number of filaments are damaged and the jointing strength cannot be maintained. In addition, in being jointed by twisting, the twisted portion becomes thick, and the cutability is deteriorated. From such a point, the monofilaments are interlaced and jointed.

The slit 103 is a tear penetrating the superposed first strand 101 and second strand 102 in the superposition direction, and has a certain length in the fiber orientation direction. Thus, the slit 103 divides the superposed portion 106 of the first strand 101 and the second strand 102 in a direction orthogonal to the fiber orientation direction. For one joint portion, one slit 103 may be provided; when a plurality of slits are provided, a plurality of slits may be provided side by side in a direction orthogonal to the fiber orientation direction.

As described above, when the joint portion 105 has a configuration in which the monofilaments of the superposed strands are interlaced and slits are provided, the flexibility of the joint portion 105 is increased and the cutability is improved. In addition, the bundle width of the chopped strand obtained by cutting the joint portion 105 can be reduced, and the number of monofilaments constituting the chopped strand can be reduced. Furthermore, the presence of the slit suppresses interlace of the monofilaments at an interlace joint portion, and the strand thickness becomes thin so that the bundle thickness of the chopped fiber bundle can be suppressed. As a result, the chopped strands are uniformly dispersed, and thereby the areal weight unevenness of the chopped strand mat or the like can be improved, and the mechanical properties can be improved.

The interval between the slits 103 is not particularly limited, and is preferably set at equal intervals in the direction orthogonal to the fiber orientation direction to obtain chopped strands having high homogeneity.

Figure 2:
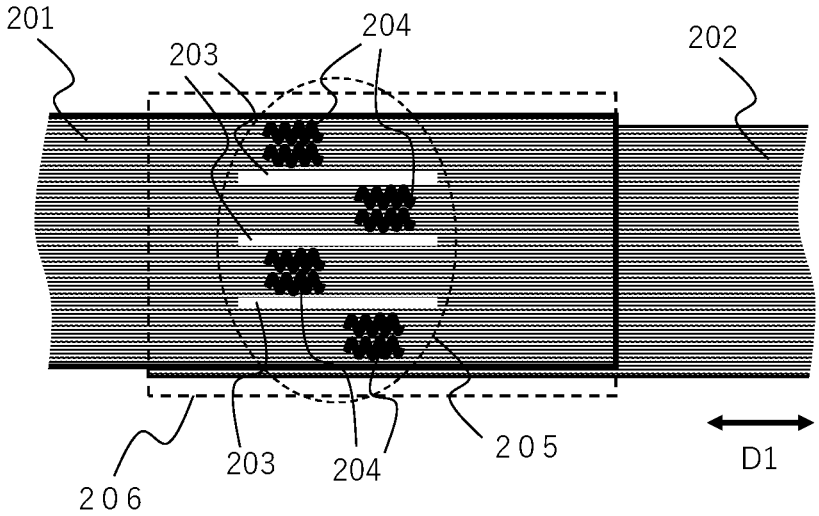
FIG. 2 is another schematic view of the jointed strand.

The joint spots 104 and 204 in which the monofilaments are interlaced may be provided side by side in a direction orthogonal to a fiber orientation direction D1 as illustrated in FIG. 1, or may be provided slightly shifted in the fiber orientation direction D1 as illustrated in FIG. 2. When the joint spot 104 is provided in a state of being arranged in the direction orthogonal to the fiber orientation direction D1, the joint portion can be efficiently produced. When the joint spot 204 is provided in a state of being slightly shifted in the fiber orientation direction D1, the flexibility of the joint portion is increased and the cutability is further improved.

Figure 5:
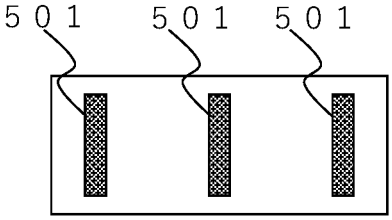
FIGS. 5(*a*) to 5(*d*) are top views illustrating a slit and a joint spot provided in the jointed strand.
Figure 5B:
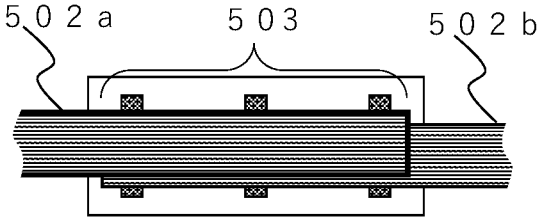
Figure 5:
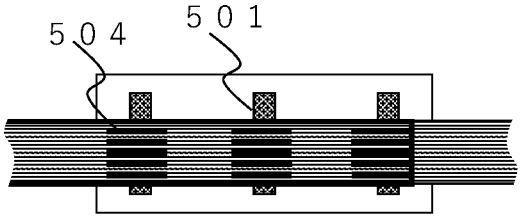
Figure 5D:
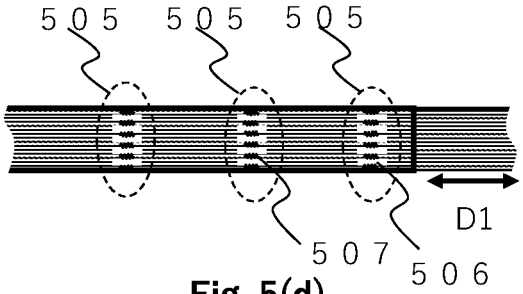

It is preferable that the joint portion is provided at 1 to 10 locations per the superposed portion in the fiber orientation direction. When one joint portion is provided for one superposed portion, the time required for joint can be shortened. On the other hand, in pulling out the strands while applying tension in the fiber orientation direction of the strands, an excessive tension acts on the joint spot 104 and, as a result, the strands may be cut. Hence, as illustrated in FIG. 5(*d*), by providing the plurality of joint portions 505 in the fiber orientation direction D1, the tension acting per joint portion can be dispersed, and the strand can be continuously supplied without being cut. Furthermore, it is possible to suppress the interlace of the monofilament per one joint portion to a low level to exhibit excellent cutability, and it is possible to reduce the breakage of the monofilament by securing the jointing strength as a whole of the superposed portion. On the other hand, when the joint portion is excessively provided, it takes time to joint, and the superposed portion needs to be provided long, which easily leads to deterioration of the material yield and an increase in variation in areal weight. Therefore, the number of joint portions is preferably 1 or more and 10 or less, and more preferably 2 or more and 5 or less in the fiber orientation direction with respect to one superposed portion.

The interval between the pluralities of joint portions existing in the fiber orientation direction is not particularly limited. When the jointed strand is cut to form a chopped strand in the next step, it is preferable to set the interval to be longer than the cut length of the chopped strand, and the equal interval between the joint portions is better in handleability.

It is preferable that one joint portion is provided with 1 to 30 slits that divide the joint portion into a plurality of portions. One slit may be provided for one joint portion; by providing a plurality of slits in the direction orthogonal to the fiber orientation direction, the flexibility of the joint portion is improved, and the cutability is further improved. Furthermore, since the bundle width of the chopped strands after cutting is reduced and the number of monofilaments constituting the chopped strands is reduced, the chopped strands are more likely to be dispersed more evenly. Therefore, the areal weight unevenness of the chopped strand mat or the like can be suppressed, and the mechanical properties can be improved. On the other hand, when the slits are excessively provided, the number of monofilaments per joint spot is reduced, the monofilaments cannot withstand the tension acting on the strand even after interlacing the monofilaments, and the jointed strand may be broken. Therefore, to secure the number of monofilaments as a joint spot that can withstand breakage, it is preferable to provide the slits at 1 to 30 locations, and it is more preferable to provide the slits at 3 to 20 locations per joint portion in the direction orthogonal to the fiber orientation direction.

The length of the joint spot in the fiber orientation direction is preferably 0.2 mm or more and less than 20 mm. When the length of the joint spot in the fiber orientation direction is long, the cutability is deteriorated, and a chopped strand having a long fiber length is produced. Therefore, the chopped strands are not uniformly dispersed, and areal weight unevenness is likely to occur in the chopped strand mat or the like. Therefore, the length of the joint spot in the fiber orientation direction is preferably 0.2 mm or more and less than 20 mm, and more preferably 0.2 mm or more and less than 10 mm.

The length of the superposed portion in the fiber orientation direction is preferably 10 to 500 mm. When the superposed portion is long, the amount of strands supplied to the producing apparatus is increased, and when some of the superposed portions are longer than the other superposed portions, this causes areal weight unevenness of the chopped strand mat and leads to deterioration of the material yield. On the other hand, when the superposed portion is short, it is not possible to provide a joint spot having a sufficient length in the superposed portion, and there is a possibility that the jointing strength is lowered. Therefore, the length of the superposed portion in the fiber orientation direction is preferably 10 to 500 mm.

The length of the slit is preferably 10 to 200 mm. When the length of the slit is short, the length of the joint spot in the fiber orientation direction is also shortened as a result, and sufficient jointing strength may not be obtained. On the other hand, when the length of the slit is long, breakage of the monofilament may be increased. In addition, when the length of the superposed portion in the fiber orientation direction becomes long, the amount of strands supplied to the producing apparatus is increased, and some of the superposed portions are longer than the other superposed portions, this causes areal weight unevenness of the chopped strand mat and leads to deterioration of the material yield. Therefore, the length of the slit may be 10 to 200 mm, which is shorter than the length of the superposed portion in the fiber orientation direction and longer than the length of the joint spot in the fiber orientation direction.

The strand is preferably made of carbon fiber. Since the monofilaments of the carbon fiber are thin, when the monofilaments are jointed by interlace, the monofilaments are well interlaced and the joint portion becomes strong.

The carbon fiber strand is not particularly limited, and it is preferable to use a carbon fiber strand in which the number of monofilaments constituting the strand is 12,000 or more and 60,000 or less. As long as the number of monofilaments is within this range, the number of monofilaments necessary for constituting each joint spot can be secured even if the slit is provided, and the breakage of the joint spot can be prevented.

In addition, we found that our concepts can be particularly suitably applied to when the strand is a strand subjected to a partial separation treatment. The partial separation treatment is a treatment of intermittently performing the fiber separation treatment along the orientation direction of the monofilaments constituting the strand (that is, a treatment of intermittently and repeatedly putting the slit in the strand). When the superposed portion of the jointed strands in which the ends of the strands subjected to the partial separation treatment are jointed to each other is a chopped strand, the characteristics of the chopped strands are not significantly changed even at the joint portion, and an effect of the partial separation is not inhibited.

Next, a method of producing a jointed strand will be described.

In addition, we provide a method of producing a jointed strand comprising: providing a superposed portion in which a first strand end in which fibers are oriented in one direction and a second strand end in which fibers are oriented in one direction are superposed; forming a joint portion by interlacing fibers of the first strand and the second strand in the superposed portion; and providing a slit extending in a fiber orientation direction and forming a joint spot adjacent to the slit by piercing a separation means in the joint portion, at one location or a plurality of locations arranged in a direction orthogonal to the fiber orientation direction.

The means for interlacing and jointing the fibers of the first strand and the second strand is not particularly limited, and means for interlacing the monofilaments of the first strand and the second strand by ejecting gas is preferable because it is possible to joint the monofilaments of the first strand and the second strand while reducing the breakage of the fibers. At this time, the strength of the joint portion of the strand may be set within a range where the strand can pass through the next step; when the joint is excessively strengthened, the cutability is deteriorated. Therefore, to prevent the strand from being divided at the joint portion even when a tensile load is applied to the first strand and the second strand, the strength of the strand joint portion is preferably 1 N or more and 500 N or less, and more preferably 5 N or more and 250 N or less. In jointing by ejecting gas, as means for changing the jointing strength of strands, there is means for changing the ejection amount, ejection pressure, and ejection time of gas.

When the length of the joint portion in the fiber orientation direction is equal to or less than the length of the superposed portion, and is 1% to 90% of the length of the superposed portion in the fiber orientation direction, sufficient strength of the joint portion can be obtained, a slit can be easily provided, and a joint portion not including a slit and connected in a direction orthogonal to the fiber orientation direction can be avoided from being provided. At this time, for example, the length of the joint portion can be controlled by controlling the length of the gas ejection port in the fiber orientation direction.

Figure 3:
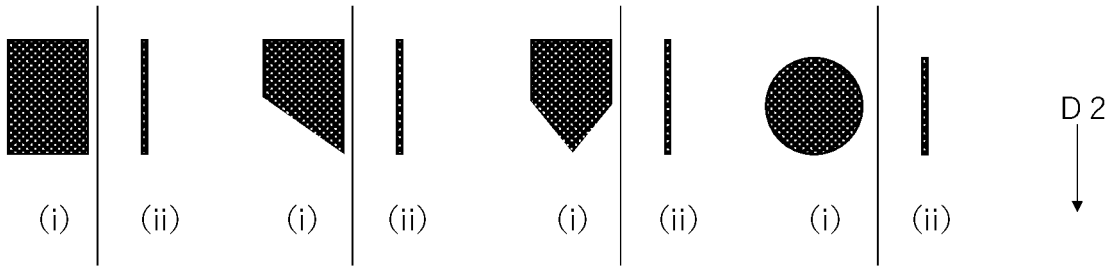
FIGS. 3(*a*) to 3(*d*) are schematic views illustrating a state in which a separation means is pierced into the jointed strand 402. In each of FIGS. 3(*a*) to 3(*d*), (*i*) is a front view and (ii) is a side view.

As a method of forming a joint portion by superposing fibers of the first strand and the second strand and interlacing the fibers, and then providing a slit in the joint portion, there is a method of piercing the strand with a plate. At this time, the fiber orthogonal direction and the thickness direction of the plate are set to be the same direction. Specifically, for example, a plurality of plates may be arranged and pierced at optional intervals in the fiber orthogonal direction to divide the strand. FIGS. 3(*a*) to 3(*d*) illustrate an example of the shape of the separation means that pierces when the slit is provided. The thickness of the separation means in the fiber orthogonal direction is not particularly limited, and is preferably thinner as long as the rigidity of the separation means is maintained, and is preferably 0.1 to 2.0 mm. A blade may be formed on an edge of the separation means, a punched state may be maintained, or a chamfering treatment may be performed. The material is not limited, and may be, for example, metal or plastic. In addition, the strand may be divided by piercing a blade such as a Thomson blade or a round blade, and at that time, for example, the strand may be divided by piercing a jig in which a plurality of blades is arranged at optional intervals in the fiber orthogonal direction.

The length of the separation means in the fiber orientation direction is preferably longer than the length of the joint spot where the fibers are interlaced. In producing a plurality of joint portions in the fiber orientation direction, the joint portions may be repeatedly (sequentially) produced, or means for producing a plurality of joint portions at a time may be used.

Figure 4:
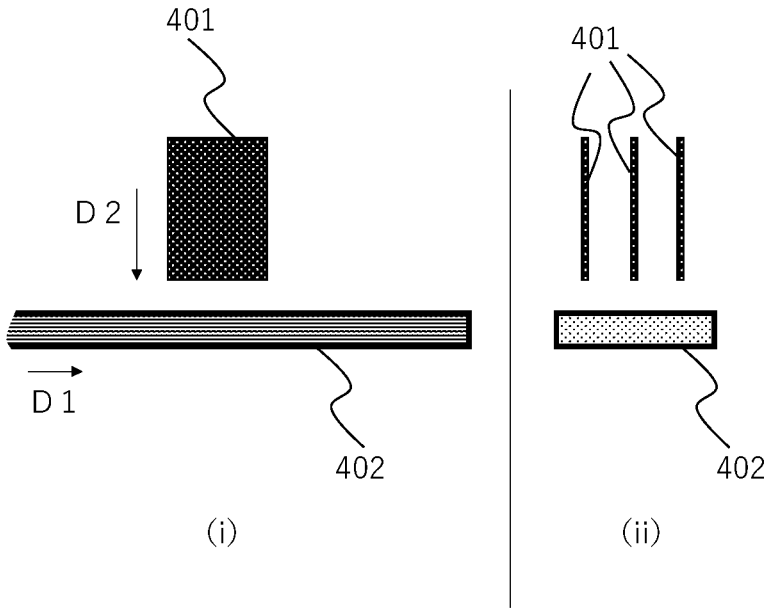
FIG. 4 is a schematic view illustrating a state in which a separation means is pierced into the jointed strand 402 to provide a slit.

FIG. 4 illustrates a conceptual diagram in which a slit is provided by piercing the separation means. As described above, if separation means 401 is pierced in the strand thickness direction along the fiber orientation direction D1 of the strand to divide the strands in the fiber orthogonal direction, the monofilament can be prevented from being broken and a slit can be provided.

In addition, the strand may be subjected to a widening treatment before the strand is jointed; by performing the widening treatment, a region where the separation means can be pierced after the strands are jointed becomes wide, and can be accurately divided into a desired division ratio.

In addition, when the separation means is pierced, slits can be accurately provided in the strands by fixing the strand ends so that the superposed strands are not shifted.

The jointed strand 402 can be produced by the following method in addition to the above method. That is, a superposed portion is provided by superposing a first strand end in which fibers are oriented in one direction and a second strand end in which fibers are oriented in one direction, a slit extending in a fiber orientation direction and a joint spot adjacent to the slit are provided by piercing a separation means in the superposed portion, at one location or a plurality of locations arranged in a direction orthogonal to the fiber orientation direction, and then fibers of the first strand and the second strand at the joint spot are interlaced to form a joint portion including the slit and the joint spot.

The means of interlacing fibers for jointing the first strand and the second strand is not particularly limited; means for interlacing the monofilaments of the first strand and the second strand by ejecting gas is preferable because it is possible to joint the monofilaments of the first strand and the second strand while reducing the breakage of the fibers. At this time, the strength of the joint portion of the strand may be set within a range where the strand can pass through the next step; when the joint portion is excessively strengthened, the cutability is deteriorated. Therefore, to prevent the strand from being divided at the joint part even when a tensile load is applied to the first strand and the second strand, the strength of the strand joint portion is preferably 1 N or more and 500 N or less, and more preferably 5 N or more and 250 N or less.

When the length of the joint portion in the fiber orientation direction is equal to or less than the length of the slit, and is 1% to 90% of the length of the slit in the fiber orientation direction, sufficient strength of the joint portion can be obtained, and a joint portion not including a slit and connected in a direction orthogonal to the fiber orientation direction can be avoided from being provided. At this time, for example, the length of the joint portion can be controlled by controlling the length of the gas ejection port in the fiber orientation direction.

By superposing the fibers of the first strand and the second strand to provide the slit, and then jointing each joint spots by interlacing, breakage of the monofilament can be reduced. As a method of providing the slit, there is a method of piercing the strand with a plate. At this time, the fiber orthogonal direction and the thickness direction of the plate are set to be the same direction. Specifically, for example, a plurality of plates may be arranged and pierced at optional intervals in the fiber orthogonal direction to divide the strand.

FIGS. 3(*a*) to 3(*d*) illustrate an example of the shape of the separation means that pierces when the slit is provided. The thickness of the separation means in the fiber orthogonal direction is not particularly limited, and is preferably thinner as long as the rigidity of the separation means is maintained, and is preferably 0.1 to 2.0 mm. A blade may be formed on an edge of the separation means, a punched state may be maintained, or a chamfering treatment may be performed. The material is not limited, and may be, for example, metal or plastic. In addition, the strand may be divided by piercing a blade such as a Thomson blade or a round blade, and at that time, for example, the strand may be divided by piercing a jig in which a plurality of blades is arranged at optional intervals in the fiber orthogonal direction. In each of FIGS. 3 (*a*) to 3 (*d*), (i) is a front view and (ii) is a side view.

The length of the separation means in the fiber orientation direction is preferably longer than the length of the joint spot where the fibers are interlaced. In producing a plurality of joint portions in the fiber orientation direction, the joint portions may be repeatedly produced, or means for producing a plurality of joint portions at a time may be used.

FIG. 4 illustrates a conceptual diagram in which a slit is provided by piercing the separation means. As described above, when separation means 401 is pierced in the strand thickness direction along the fiber orientation direction D1 of the strand to divide the strands in the fiber orthogonal direction, the monofilament can be prevented from being broken and a slit can be provided.

In addition, the strand may be subjected to a widening treatment before the strand is jointed; by performing the widening treatment, a region where the separation means can be pierced after the strands are jointed becomes wide, and can be accurately divided into a desired division ratio.

In the production method, it is also preferable that at least one strand of the first strand and the second strand is a strand subjected to a partial separation treatment. By using the strand subjected to the partial separation treatment in advance, when the chopped strand is formed, the characteristics of the chopped strand are not significantly changed even at the joint portion, and the effect of the partial separation is not inhibited.

EXAMPLES

Hereinafter, our jointed strands and methods will be more specifically described with reference to Examples.

Evaluation of Jointed Strand

Cutability: Whether or not the chopped strand after cutting had a desired fiber length was visually checked.

Dispersity: Whether or not the chopped strand after being sprayed using a SMC producing device was concentrated and dropped at one place was visually checked.

Areal weight unevenness: Whether or not a large bundle was sprayed, and a bulk height locally changed was visually checked.

Division width: The strand joint portions aligned in the fiber orientation direction were pressed with an acrylic plate at a pressure of 400 Pa, and then the length between the slits was measured with a caliper.

Number of filaments: The number of filaments of the chopped strand was intermittently calculated using the following equation.

Number of filaments=Chopped strand weight/Chopped strand length/Filament fineness Evaluation of SMC·molded article Areal weight: SMC was cut in a width direction to be 300 mm in a longitudinal direction, and then a weight obtained by subtracting the weight of a carrier sheet from the measured weight was divided by an area calculated from the width and the length of SMC in the longitudinal direction of 300 mm.

Fiber weight content: SMC was cut in the width direction to be 300 mm in the longitudinal direction, and then a weight Ws obtained by subtracting a film weight from the measured weight was calculated. In addition, a matrix resin contained in the cut SMC was melted with a solvent and then held in an electric furnace at 550° C. for 2 and a half hours to volatilize the solvent, and a remaining fiber weight Wf was measured. Then, the ratio of Wf to Ws was calculated.

Appearance·Presence of Defect: Whether or not the molded article was swollen or cracked was visually checked.

Example 1

As a strand, a continuous carbon fiber strand (product name: "ZOLTEK (registered trademark)" PX35-50K available from Zoltek Companies, Inc.) having 50,000 filaments was used.

Two strands were prepared, and the ends of the two strands were superposed in the fiber orientation direction to provide a superposed portion of 50 mm. A stainless steel flat plate having a plate thickness of 0.2 mm and a length of 100 mm was pierced into the superposed portion so that the length direction of the flat plate was the same as the fiber orientation direction of the strand, thereby providing five slits having a length of 45 mm, and a joint spot in which monofilaments were interlaced using an air splicer (air splicer available from MESDAN (product name: JOINTAIR (registered trademark), Model: 116)) was formed in the superposed portion partitioned by the slits to obtain a jointed strand. The length of the joint spot in the fiber orientation direction was 8 mm.

When the jointed strand was set in the SMC producing device and cut using a strand cutting machine so that the chopped strand had a length of 25.4 mm, we visually confirmed that chopped strands of one joint portion divided into six portions, and excellent cutability and dispersity were exhibited. Also, in the state in which the chopped strands were sprayed, that is, in the form of the chopped strand mat, the areal weight unevenness due to contamination of the large chopped strands did not occur. In addition, we confirmed that the obtained bundle width of the chopped strands was the width of the strands when divided, and the bundle width could be controlled. We confirmed that the number of filaments constituting the chopped strands was about 10,000 to 20,000, and the control of the number was performed. The SMC producing device includes a strand cutting machine 1,300 mm above the first carrier sheet conveyed horizontally, and the chopped strands that have been cut are beaten and sprayed by a distributor located 700 mm below the strand cutting machine. The distributor includes a rotation shaft and wires arranged around the rotation shaft; 12 wires are attached at equal intervals to be circular as viewed in the axial direction, the rotation shaft is attached to be orthogonal to the conveying direction of the first carrier sheet and horizontal, and the distributor is rotated so that the wire has a speed of 4 m/sec, thereby the chopped strand that has been cut and dropped collides with the wire, is blown forward, and is sprayed by free fall.

Thereafter, a first carrier sheet made of polypropylene was pulled out from a first original fabric roll and supplied to a first conveyor, and a matrix resin [A] paste was applied onto the first carrier sheet with a predetermined thickness using a doctor blade to form a first resin sheet.

The jointed strand was cut into a chopped strand using a strand cutting machine of a SMC producing device, to have a length of 25.4 mm. Next, the chopped strands were dropped on the first resin sheet and sprayed to continuously form a sheet-like chopped strand in which the chopped strands were randomly oriented.

Next, a second carrier sheet made of polypropylene was pulled out from a second original fabric roll and supplied to a second conveyor, and the matrix resin [A] paste was applied onto the second carrier sheet with a predetermined thickness using a doctor blade to form a second resin sheet.

Thereafter, a second resin sheet was bonded and stacked on the sheet-like chopped strand, and the sheet-like chopped strand was impregnated with the matrix resin [A] by pressurization from both sides to produce SMC. The obtained SMC had an areal weight of 2,000 g/m$^2$ and a fiber weight content of 57%.

Thereafter, the produced SMC was cured at a temperature of 25±5° C. for 1 week after production, and then the SMC was cut into 265×265 mm. Three sheets were stacked to align the conveying direction (MD direction) of the SMC in the SMC production device, and disposed (corresponding to 80% in terms of charge rate) at a central portion on a flat plate mold having a cavity of 300×300 mm. Thereafter, the SMC was cured by a heating type press molding machine under a condition of about 140° C.×5 minutes under a pressure of 10 MPa to obtain a flat plate-shaped molded article of 300 mm×300 mm×3 mm. We visually confirmed that the molded article had an excellent appearance, and there was no defect due to contamination of the strand joint portion.

Raw Material Used

Matrix Resin [A]:

A resin obtained by mixing 100 parts by weight of a vinyl ester resin (VE) ("DERAKANE 790" (registered trademark) available from The Dow Chemical Company), 1 part by weight of tert-butyl peroxybenzoate (PERBUTYL Z (registered trademark) available from NOF CORPORATION), 2 parts by weight of zinc stearate (SZ-2,000 available from Sakai Chemical Industry Co., Ltd.), and 4 parts by weight of magnesium oxide (MgO #40 available from Kyowa Chemical Industry Co., Ltd.) was used.

Example 2

Figure 6:
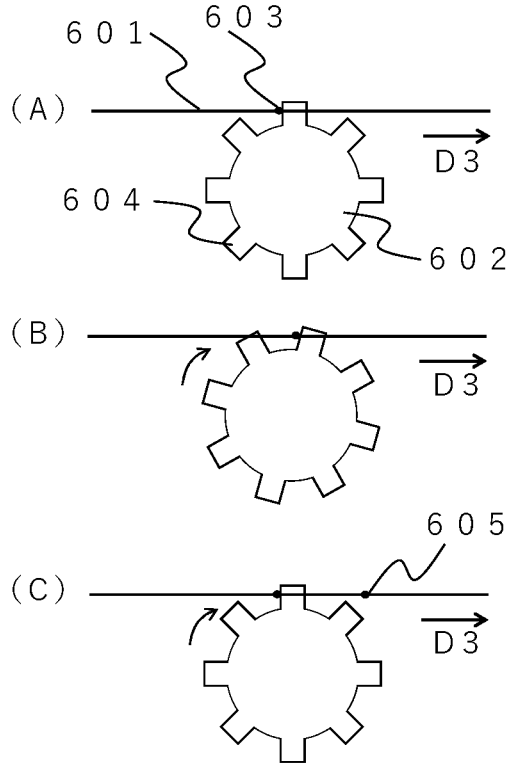
FIG. 6 is a view illustrating one example of a separation means.

As a strand, a continuous carbon strand (product name: "ZOLTEK (registered trademark)" PX35-50K available from Zoltek Companies, Inc.) having 50,000 filaments was prepared, and the strand was previously widened. A separation treatment means was prepared by setting an iron plate for a separation treatment having a protruding shape with a thickness of 0.3 mm, a width of 3 mm, and a height of 20 mm in parallel at equal intervals of 5 mm with respect to the width direction of the strand, and intermittently inserted and extracted against the expanded strand as illustrated in FIG. 6 to produce a partially separated fiber bundle (strand).

Two partially separated fiber bundles (strands) were prepared, and the respective strand ends were aligned to provide a superposed portion of 80 mm. To provide three joint portions in the fiber orientation direction in the superposed portion, slits having a length of 70 mm were provided at five positions in the fiber orthogonal direction, and then a treatment of interlacing the strands with air was performed using an apparatus illustrated in FIGS. 5(*a*) to 5(*d*) to obtain a jointed strand in which two strands were jointed at three joint portions. FIG. 5(*a*) is a schematic view of an air blower 500 having an air ejecting portion 501, FIG. 5(*b*) is a view illustrating a state in which ends of two strands are superposed on the air blower 500, FIG. 5(*c*) is a view illustrating a state in which air is ejected in a state in which a strand dividing blade 504 (separation means) is pierced into the superposed portion, and FIG. 5(*d*) is a schematic view of the obtained jointed strand. The length of each of the air ejecting portions 501 illustrated in FIG. 5(*a*) in the fiber orientation direction was 5 mm, and the length of the joint spot 507 in the fiber orientation direction was 7 mm.

When the jointed strand was set in the SMC producing device and cut using a strand cutting machine in the same manner as in Example 1, we visually confirmed that the joint portion was divided into six portions to be chopped strands, and excellent cutability and dispersity were exhibited. The number of filaments of the chopped strand was about 10,000 to 20,000. Also, in the state in which the chopped strands were sprayed, that is, in the form of the chopped strand mat, the areal weight unevenness due to contamination of the large chopped strands did not occur. In addition, we confirmed that the bundle width of the chopped strands was also the division width of the strand joint portion, and the bundle width could be controlled.

Thereafter, SMC was produced in the same manner as in Example 1, SMC having a fiber weight content of 57% at an areal weight of 2,000 g/m$^2$. The produced SMC was cured at a temperature of 25±5° C. for 1 week after production, and then a flat plate-shaped molded article was produced in the same manner as in Example 1. As a result, we visually confirmed that the molded article had an excellent appearance and there was no defect due to contamination of the strand joint portion.

Example 3

A jointed strand was produced in the same manner as in Example 2 except that five air ejecting portions were provided to provide five joint portions in the fiber orientation direction in the superposed portion, the length of the air ejecting portions in the fiber orientation direction was set to 4 mm, and the length of the joint spots in the fiber orientation direction was set to 5 mm.

When the jointed strand was set in the SMC producing device and cut using a strand cutting machine in the same manner as in Example 1, we visually confirmed that the joint portion was divided into six portions to be chopped strands, and excellent cutability and dispersity were exhibited, and the number of filaments of the chopped strand was about 10,000 to 20,000. Also, in the state in which the chopped strands were sprayed, that is, in the form of the chopped strand mat, the areal weight unevenness due to contamination of the large chopped strands did not occur. In addition, we confirmed that the bundle width of the chopped strands was also the division width of the strand joint portion, and the bundle width could be controlled.

Thereafter, SMC was produced in the same manner as in Example 1, SMC having a fiber weight content of 57% at an areal weight of 2,000 g/m$^2$. The produced SMC was cured at a temperature of 25±5° C. for 1 week after production, and then a flat plate-shaped molded article was produced in the same manner as in Example 1. As a result, we visually confirmed that the molded article had an excellent appearance and there was no defect due to contamination of the strand joint portion.

Comparative Example 1

As a strand, a continuous carbon strand (product name: "ZOLTEK (registered trademark)" PX35-50K available from Zoltek Companies, Inc.) having 50,000 filaments was used.

Two strands were prepared, each strand was aligned to provide a 30 mm superposed portion, and monofilaments were interlaced and jointed using an air splicer (air splicer available from MESDAN (product name: JOINTAIR (registered trademark), Model: 116)). The length of the joint spot where the monofilaments were interlaced in the fiber orientation direction was 8 mm. The joint portion (the same range as the joint spot in the comparative examples) was thicker than that in a state in which two strands were just superposed due to the interlace of the monofilaments, and was thicker than that in examples.

When the jointed strand was set in the SMC producing device and cut using a strand cutting machine so that the chopped strand had a length of 25.4 mm, the number of monofilaments in the joint portion was 99,000 to 101,000, and the number of monofilaments was larger than that in the non-joint portion having 49,000 to 51,000 monofilaments. In addition, we confirmed that, although the joint portion was tried to be cut by the cutter, the strand was not cut, and the chopped strand length became longer than 25.4 mm and became 50.8 mm, or was cut in a partially connected state, and the cutability was poor and the dispersity was also poor. Also, in the state in which the chopped strands were sprayed, that is, in the form of the chopped strand mat, the areal weight was locally deteriorated due to contamination of the large chopped strands. Further, we confirmed that the bundle width of the chopped strands was the bundle width of the strands.

Thereafter, SMC was produced in the same manner as in Example 1 to obtain SMC having a fiber weight content of 57% at an areal weight of 2,000 g/m$^2$. The produced SMC was cured at a temperature of 25±5° C. for 1 week after production, and then a flat plate-shaped molded article was produced in the same manner as in Example 1. As a result, large chopped strands derived from the joint portion were confirmed on the surface of the molded article, and swelling occurred in the molded article due to contamination of the strand joint portion.

Comparative Example 2

As a strand, a continuous carbon strand (product name: "ZOLTEK (registered trademark)" PX35-50K available from Zoltek Companies, Inc.) having 50,000 filaments was prepared, and the strand was previously widened. A separation treatment means was prepared by setting an iron plate for a separation treatment having a protruding shape with a thickness of 0.3 mm, a width of 3 mm, and a height of 20 mm in parallel at equal intervals of 5 mm with respect to the width direction of the strand, and was intermittently inserted and extracted against the expanded strand as illustrated in FIG. 6 to produce a partially separated fiber bundle (strand).

Two strands were prepared, each strand was aligned to provide a 30 mm superposed portion, and monofilaments were interlaced and jointed using an air splicer (air splicer available from MESDAN (product name: JOINTAIR (registered trademark), Model: 116)). The length of the joint spot where the monofilaments were interlaced in the fiber orientation direction was 8 mm. In this comparative example, although a partially separated fiber bundle was used, the entire joint portion was thicker than that in a state in which two strands were superposed due to the interlace of the monofilaments, and was thicker compared to that in Example 2.

When the jointed strand was set in the SMC producing device and cut using a strand cutting machine so that the chopped strand had a length of 25.4 mm, the number of monofilaments in the joint portion was 99,000 to 101,000, and the number of monofilaments was larger than that in the non-joint portion having 2,000 to 4,000 monofilaments. In addition, we confirmed that, although the joint portion was tried to be cut by the cutter, the strand was not cut, and the chopped strand length became longer than 25.4 mm and became 50.8 mm, or was cut in a partially connected state, and the cutability was poor and the dispersity was also poor. Also, in the state in which the chopped strands were sprayed, that is, in the form of the chopped strand mat, the areal weight was locally deteriorated due to contamination of the large chopped strands. Further, the bundle width of the chopped strands not including the joint portion was 5 mm of a separation treatment width, whereas the bundle width of the chopped strands including the joint portion was the bundle width of the strands.

Thereafter, SMC was produced in the same manner as in Example 1 to obtain SMC having a fiber weight content of 57% at an areal weight of 2,000 g/m$^2$. The produced SMC was cured at a temperature of 25±5° C. for 1 week after production, and then a flat plate-shaped molded article was produced in the same manner as in Example 1. As a result, large chopped strands derived from the joint portion were confirmed on the surface of the molded article, and swelling occurred in the molded article due to contamination of the strand joint portion.

Comparative Example 3

As a strand, a continuous carbon strand (product name: "ZOLTEK (registered trademark)" PX35-50K available from Zoltek Companies, Inc.) having 50,000 filaments was used.

Two strands were prepared, the strands were aligned, the strand bundle ends were divided into five groups (A1, A2, . . . A5) and (B1, B2, . . . B5), respectively; (A1 and B1), (A2 and B2), . . . (A5 and B5) were aligned, a 30 mm superposed portion was provided, each aligning portion was inserted into a tubular passage, and compressed air of 0.6 MPa was ejected to the passage to twist the strands. At this time, the compressed air was ejected without fixing the strand ends so that the strand ends were freely rotated and twisted in the passage. The length of the twisted portion in the fiber orientation direction was 30 mm. In addition, the twisted portion was wound and tightened by being twisted, had a wall thickness, was thicker than the thickness of two strands superposed, and was thicker compared to that in Examples 1 and 2. Furthermore, no interlace of the monofilaments between strands was observed at the twisted portion.

When the jointed strand was set in the SMC producing device and cut using a strand cutting machine so that the chopped strand had a length of 25.4 mm, the number of monofilaments in the joint portion was 99,000 to 101,000, and the number of monofilaments was larger than that in the non-joint portion having 49,000 to 51,000 monofilaments. In addition, we confirmed that, although the joint portion was tried to be cut by the cutter, the strand was not cut, and the chopped strand length became longer than 25.4 mm and became 50.8 mm, or was cut in a partially connected state, and the cutability was poor and the dispersity was also poor. Also, in the state in which the chopped strands were sprayed, that is, in the form of the chopped strand mat, the areal weight was locally deteriorated due to contamination of the large chopped strands.

Thereafter, SMC was produced in the same manner as in Example 1 to obtain SMC having a fiber weight content of 57% at an areal weight of 2,000 g/m$^2$. The produced SMC was cured at a temperature of 25±5° C. for 1 week after production, and then a flat plate-shaped molded article was produced in the same manner as in Example 1. As a result, large chopped strands derived from the joint portion were confirmed on the surface of the molded article, and swelling occurred in the molded article due to contamination of the strand joint portion.

INDUSTRIAL APPLICABILITY

Our jointed strands and methods of producing a jointed strand can be preferably applied to production of a short fiber-reinforced composite material such as SMC or a stampable sheet including a step of continuously cutting the strand into chopped strands.

The invention claimed is:

1. A method of producing a jointed strand comprising:

providing a superposed portion by superposing a first strand end in which fibers are oriented in one direction and a second strand end in which fibers are oriented in one direction;

providing a slit extending in a fiber orientation direction at one point or at a plurality of points arranged in a direction orthogonal to the fiber orientation direction by piercing a separation means in the superposed portion, and forming a joint spot adjacent to the slit, wherein the slit and the joint spot are alternately arranged in a direction orthogonal to the fiber orientation direction within the superposed portion; and jointing the first strand and the second strand at the joint spot by interlacing monofilaments to form a joint portion including the slit and the joint spot.

2. The method according to claim 1, wherein a gas is ejected to interlace the monofilaments of the first strand and the second strand.

3. The method according to claim 1, wherein at least one strand of the first strand and the second strand is a strand subjected to a partial separation treatment.

4. The method according to claim 2, wherein at least one strand of the first strand and the second strand is a strand subjected to a partial separation treatment.

5. A method of producing a jointed strand comprising:

providing a superposed portion in which a first strand end in which fibers are oriented in one direction and a second strand end in which fibers are oriented in one direction are superposed;

forming a joint portion by interlacing monofilaments of the first strand and the second strand in the superposed portion; and providing a slit extending in a fiber orientation direction and forming a joint spot adjacent to the slit by piercing a separation means in the joint portion, at one location or a plurality of locations arranged in a direction orthogonal to the fiber orientation direction, wherein the slit and the joint spot are alternately arranged in a direction orthogonal to the fiber orientation direction within the superposed portion.

6. The method according to claim 5, wherein a gas is ejected to interlace the monofilaments of the first strand and the second strand.

7. The method according to claim 5, wherein at least one strand of the first strand and the second strand is a strand subjected to a partial separation treatment.

* * * * *